United States Patent [19]

Pringle et al.

[11] Patent Number: 4,566,540

[45] Date of Patent: Jan. 28, 1986

[54] HYDRAULICALLY ACTUATED CONTROL FLUID COMMUNICATION NIPPLE

[75] Inventors: Ronald E. Pringle; William D. Eatwell, both of Houston, Tex.

[73] Assignee: Camco, Incorporated, Houston, Tex.

[21] Appl. No.: 624,431

[22] Filed: Jun. 25, 1984

[51] Int. Cl.[4] ..... E21B 34/10

[52] U.S. Cl. ..... 166/317; 166/72; 166/242; 166/318; 166/323; 166/334

[58] Field of Search ..... 166/72, 317, 318, 242, 166/374–376, 332, 334, 323, 321; 137/68 R

[56] References Cited

U.S. PATENT DOCUMENTS

| | | | |
|---|---|---|---|
| 3,799,258 | 3/1974 | Tausch | 166/72 |
| 3,882,935 | 5/1975 | Calhoun | 166/323 |
| 4,119,146 | 10/1978 | Taylor | 166/72 |
| 4,249,599 | 2/1981 | Krause | 166/72 |
| 4,411,316 | 10/1983 | Carmody | 166/72 |
| 4,460,046 | 7/1984 | Pringle | 166/317 |

*Primary Examiner*—James A. Leppink
*Assistant Examiner*—Hoang C. Dang
*Attorney, Agent, or Firm*—Fulbright & Jaworski

[57] ABSTRACT

A hydraulic actuated communication nipple for switching control fluid from one location to a second location in a well tool. A body having a longitudinal bore includes a control fluid passageway adapted to be connected to the well surface. A vertical moving sleeve in the body opens communication from the fluid passageway to the bore and is connected to a hydraulic piston in the fluid passageway which includes a bypass opening normally passing fluid through the passageway. A ball dropped down the control line seats on the piston, closes the fluid passage, moves the sleeve, and opens the fluid passageway to the bore. The piston also actuates a vertical moving plug to seal off the outlet with a metal-to-metal seal. A dual communication nipple may be provided which are internally connected by a line to move the fluid displaced by a piston.

12 Claims, 8 Drawing Figures

HYDRAULICALLY ACTUATED CONTROL FLUID COMMUNICATION NIPPLE

BACKGROUND OF THE INVENTION

U.S. patent application Ser. No. 440,667 filed Nov. 10, 1982, entitled Control Fluid Communication Nipple and U.S. patent application Ser. No. 565,324, filed Dec. 27, 1983, entitled Hydraulic Control Fluid Communication Nipple are directed to control fluid communication nipples for switching control fluid from one well tool to a second location in a well tubing for controlling a second well tool. This prior art obtained a secondary communication to the well tubing from a control line by mechanically shifting a sleeve. In order to mechanically shift the sleeve and then place a secondary well tool or valve in place in a well tubing requires several trips down the well tubing with a wireline and shifting tool to actuate the sleeve and then to set a secondary valve. The present invention is directed to an improved control fluid communication nipple which is hydraulically actuated from the well surface thereby eliminating a wireline mechanical actuation of the shifting sleeve and allows a secondary valve to be placed in position before shifting the sleeve for minimizing the downhole trips and provides a cleaner operation.

SUMMARY

The present invention is directed to a control fluid communication nipple for switching control fluid from one location to a second location in a well tool and includes a body having a longitudinal bore therethrough. A fluid passageway is provided in the body offset from the bore and is adapted to be connected to the well surface for receiving hydraulic control fluid for normally supplying control fluid to a first location. Vertical moving means in the body is provided for opening communication of the fluid passageway to the bore and a hydraulic piston is connected to the vertical moving means and is movable in the passageway in the body. The piston includes means responsive to control from the well surface for moving the vertically moving means and switching the control fluid from the fluid passageway to the bore.

Another object of the present invention is wherein the piston includes a bypass opening therethrough which includes a seat adapted to receive a valve element therein for closing the opening.

Still a further object of the present invention is wherein the vertically moving means is a sleeve telescopically engaging the body to form part of the fluid passageway and seal means are provided between the sleeve and the body adjacent the top and bottom of the sleeve. One or more openings are provided to the sleeve initially positioned above the upper seal but is positioned below the upper seal, opening fluid communication, when the sleeve is vertically moved downward by the piston.

Still a further object is wherein the vertically moving sleeve means shuts off communication of fluid in the passageway to the first location in response to movement of the hydraulic piston.

Still a further object of the present invention is wherein the opening in the sleeve is spaced below the upper end of the sleeve a distance whereby when the opening is positioned below the upper seal the upper end of the sleeve will cover the upper seal preventing the upper seal from falling into the bore.

Still a further object of the present invention is the provision of a hydraulic control fluid communication nipple with a body having a longitudinal bore therein and a fluid passageway offset from the bore having an inlet and an outlet in which the fluid passageway is adapted to be connected to the well surface through a control line for receiving hydraulic control fluid for normally supplying control fluid to the outlet. A vertically moving sleeve opens communication of the fluid passageway to the bore and is connected to a hydraulic piston movable in the fluid passageway between the inlet and the outlet. The piston includes a bypass opening therethrough for normally passing fluid from the inlet to the outlet. The opening includes a seat adapted to receive a valve element from the well surface through the control line for closing communication of the control fluid to the outlet, moving the sleeve, and opening communication of the fluid passageway to the bore.

Still a further object of the present invention is the provision of first and second switching nipples each of which include a fluid passageway in the body having an inlet and an outlet and offset from the bore and adapted to be connected to a control line to the well surface for receiving control fluid for normally supplying the fluid to a first location. Each of the nipples includes a vertically moving sleeve for opening communication of their respective fluid passageways to the bore, and each of the nipples includes a hydraulic piston connected to the sleeve, movable in the fluid passageway and responsive to control from the well surface for moving the sleeve and switching control fluid to the bore. Each of the switching nipples includes a vertically moving means for shutting off communication of the fluid in the fluid passageway to the outlet by metal-to-metal seal in response to movement of the hydraulic piston. A line may be provided from the underside of the piston of the fluid passageway of one nipple to the fluid passageway on the top side of the piston of the other nipple for receiving the displaced fluid from the one nipple. The vertical moving means of the second nipple may include a check valve for allowing displacement of the hydraulic fluid in the second nipple.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

Figure 1:
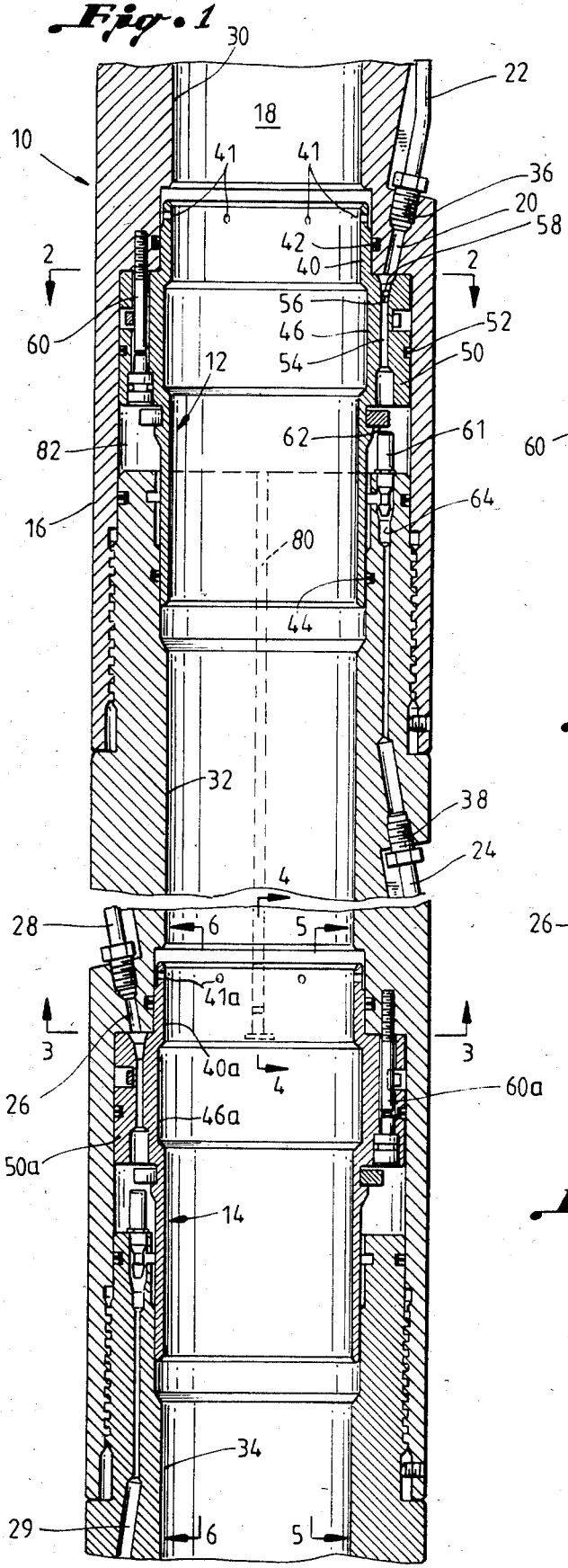
FIG. 1 is a fragmentary elevational view, in cross section, of the hydraulically actuated control fluid communication nipple of the present invention.
Figure 2:
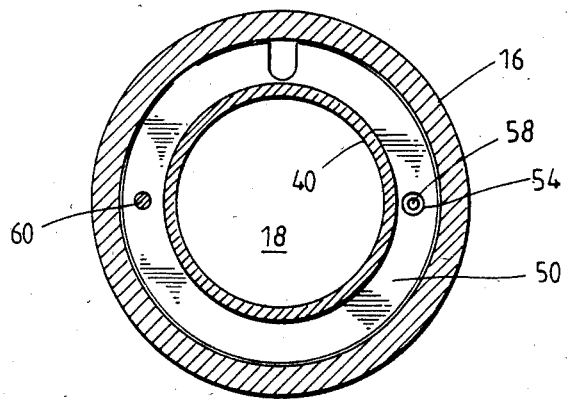
FIG. 2 is a cross-sectional view taken along the line 2—2 of FIG. 1.
Figure 3:
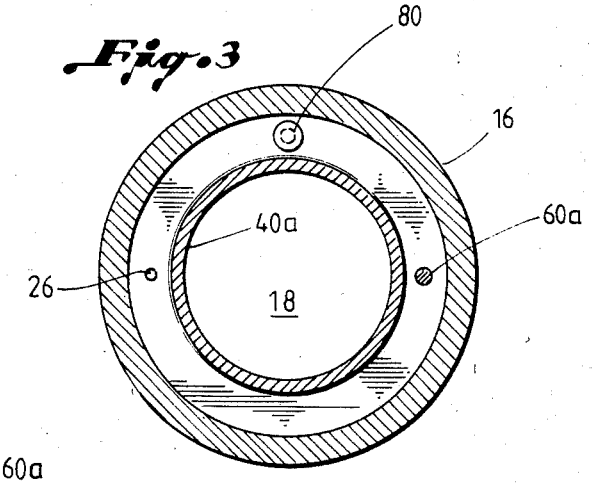
FIG. 3 is a cross-sectional view taken along the line 3—3 of FIG. 1.
Figure 4:
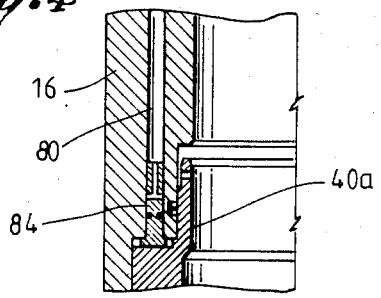
FIG. 4 is a cross-sectional view taken along the line 4—4 of FIG. 1.

Referring now to the drawings, and particularly to FIG. 1, the reference numeral 10 generally indicates the control fluid communication nipple of the present invention which includes an upper nipple generally indicated by the reference numeral 12 and a lower nipple generally indicated by the reference numeral 14. The communication nipple 10 includes a body 16 having a longitudinal bore 18 therethrough. The upper nipple 12 includes a fluid passageway 20 offset from the bore 18 which is adapted to be connected to the well surface through a control line 22 for receiving hydraulic control fluid for supplying the control fluid to a first location such as through line 24 or alternately to a second location such as the bore 18 of the upper nipple 12.

The lower nipple 14 includes a fluid passageway 26 which is adapted to be connected to the well surface such as through a control line 28 for receiving hydraulic control fluid for normally supplying control fluid to a location through the line 29 or alternatively to the bore 18 of the body 16.

As described in U.S. patent application Ser. No. 440,667, and U.S. patent application Ser. No. 565,324, above described and owned by the same assignee as the present application, the present communication nipple 10 is adapted to be inserted in the tubing of an oil and/or gas well for normally supplying control fluid to a downhole tubing safety valve through one or both of the lines 22 and 28. That is, only one of the lines 22 or 28 need be used if the tubing safety valve is controlled by a single control line to the well surface. In the event that the tubing safety valve is a balanced safety valve requiring two control lines then both control lines 22 and 28 are utilized. However, in the event of a failure of the tubing safety valve, a second retrievable safety valve is positioned in the interior of the bore 18 of the nipple 10 for receiving control fluid in the second location 18 and is controlled through one or both of the lines 22 and 28. The nipple 10 includes polished sections 30, 32, and 34 for accommodating seals on the second retrievable safety valve. However, it is to be recognized that the present invention may be useful in controlling and communicating fluid for actuating various other types of well tools. If the safety valve or other well tool to be inserted in the bore 18 only requires a single control line, only one of the nipples 12 and 14 is needed and the other may be omitted.

The passageway 20 includes an inlet 36 for connection to the control line 22 leading to the well surface and an outlet 38 for connection to the line 24 leading to the downhole tool such as a safety valve. A vertical moving means such as a shifting sleeve 40 is telescopically movable in the body 16 for switching the control fluid in the passageway 20 from the outlet 38 to the bore 18. The sleeve 40 normally seals the fluid in the passageway 20 from the bore 18 by the seals 42 and 44. The sleeve 40 includes a notch 46 for mechanically moving the sleeve 40 if needed. However, the sleeve 40 is connected to a hydraulic piston 50 which is positioned in the fluid passageway 20 and has a piston ring 52. The piston 50 includes a bypass opening 54 therein for normally passing fluid from inlet 36 to the outlet 38 for normally operating the downhole tubing safety valve. The opening 54 also includes a valve seat 56 for receiving a valve element such as a ball 58 from the well surface through the line 22 when it is desired to actuate the piston. The sleeve 40 is initially held in the up position by a shearable bolt 60. In the event that the primary or tubing safety valve becomes inoperable, it is desirable to position a second or retrievable type safety valve (not shown) in the polished bores 30, 32 and 34 of the nipple 10 in which the second safety valve is controlled by fluid in the passageway 20 supplied to the bore 18. In this event, the valve element or ball 58 is dropped from the well surface through the control line 22 and seats on the valve seat 56 closing the communication of the passageway 20 with the outlet 38. An increase of fluid pressure in the line 22 will then act against the piston 50, shears the bolt 60, and moves the piston 50 and the shifting sleeve 40 downwardly. The upper end of the sleeve 40 includes one or more openings 41 which when moved down below the upper seal 42 and provides fluid communication of the control fluid from the inlet 36 to the bore 18 between the polished sections 30 and 32 for actuating the second retrievable safety valve positioned therein.

While the downward movement of the sleeve 40 will open communication between the passageway 20 and the bore 18 and the seating of the ball 58 on the seat 56 along with the seals 42, 44 and 52 will shut off flow of the control fluid from the passageway 20 to the outlet 38, it is desirable that the control fluid be shut off from the outlet 38 by a metal-to-metal seal to overcome the possibility that the elastomer seals may fail. Thus, a metal plug 61 is provided which is adapted to be driven downwardly by a shoulder 62 connected to the sleeve 40 and into a recess 64 in the passageway 20 to provide a metal-to-metal seal. The metal seal is advantageous over usual elastomer seals as it can withstand the hostile environment of high temperature and corrosive fluids which are present in many wells.

Figure 5A:
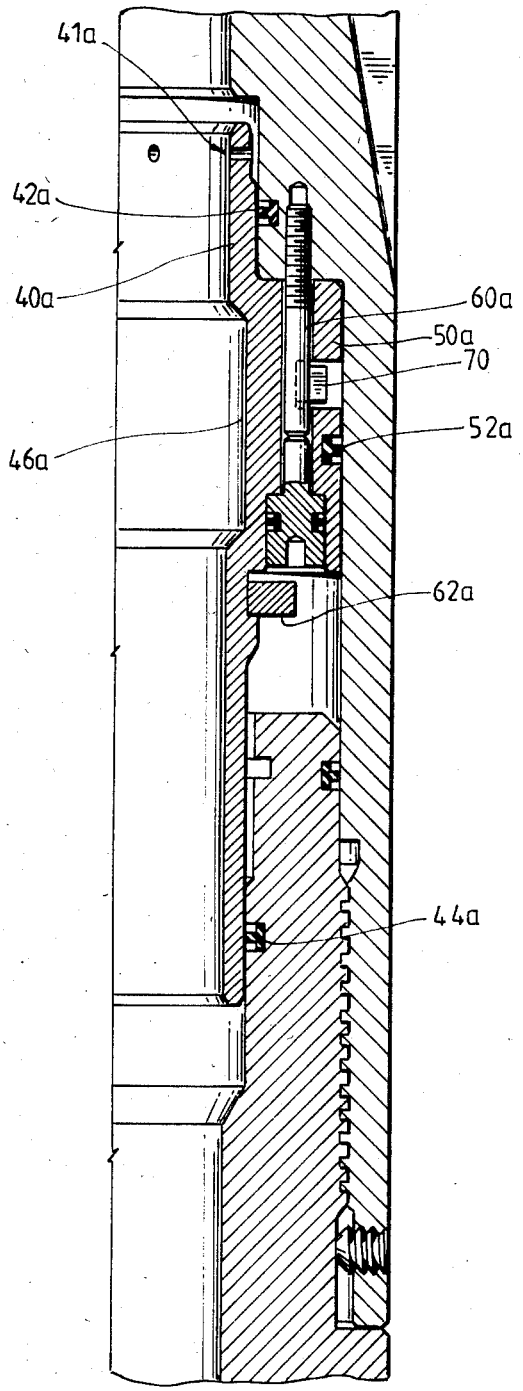
FIG. 5A is an enlarged cross-sectional view taken along the line 5—5 of FIG. 1.
Figure 5B:
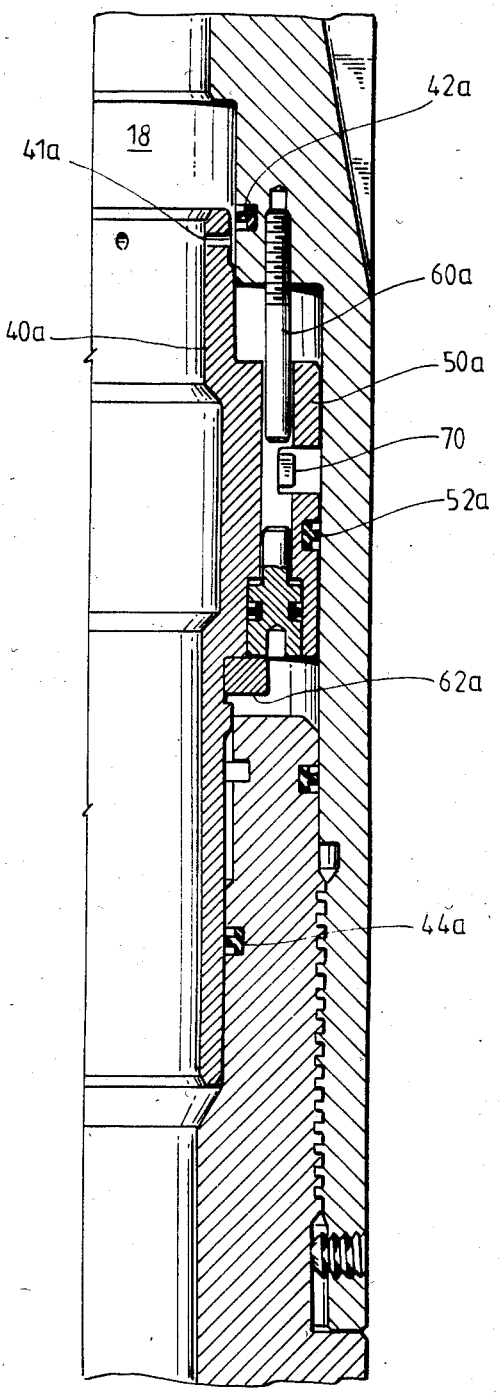
FIG. 5B is a view similar to FIG. 5A after actuation of the hydraulic piston.
Figure 6A:
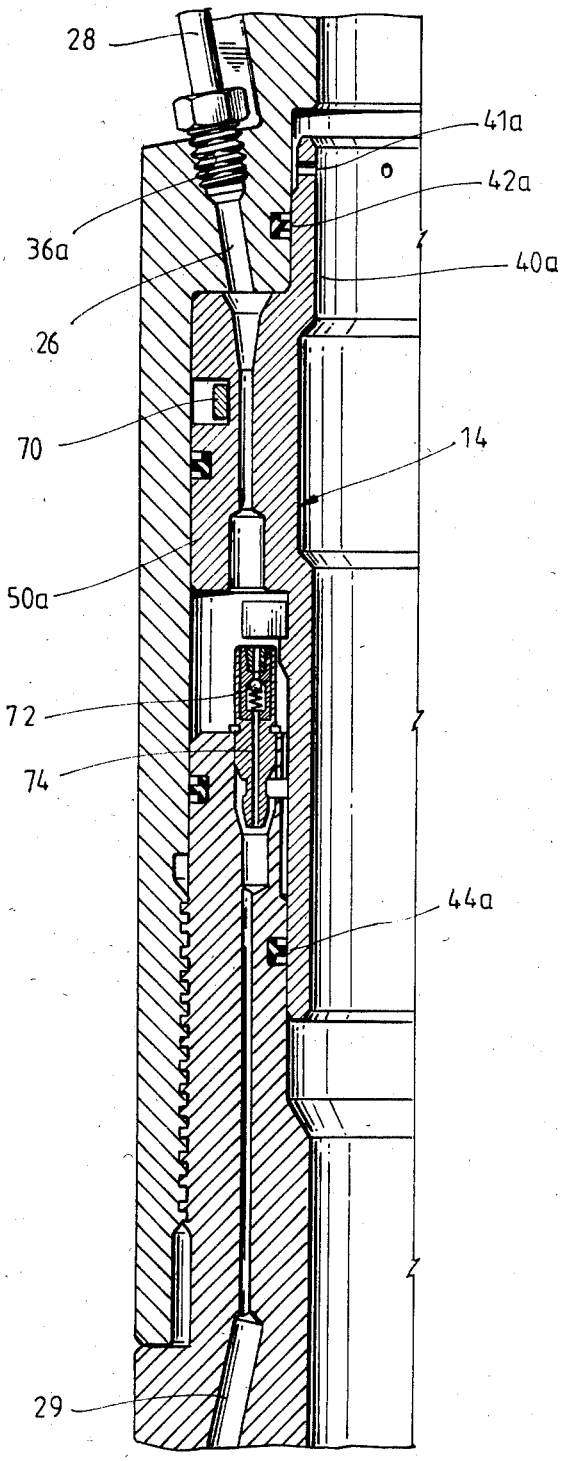
FIG. 6A is an enlarged cross-sectional view taken along the line 6—6 of FIG. 1.
Figure 6B:
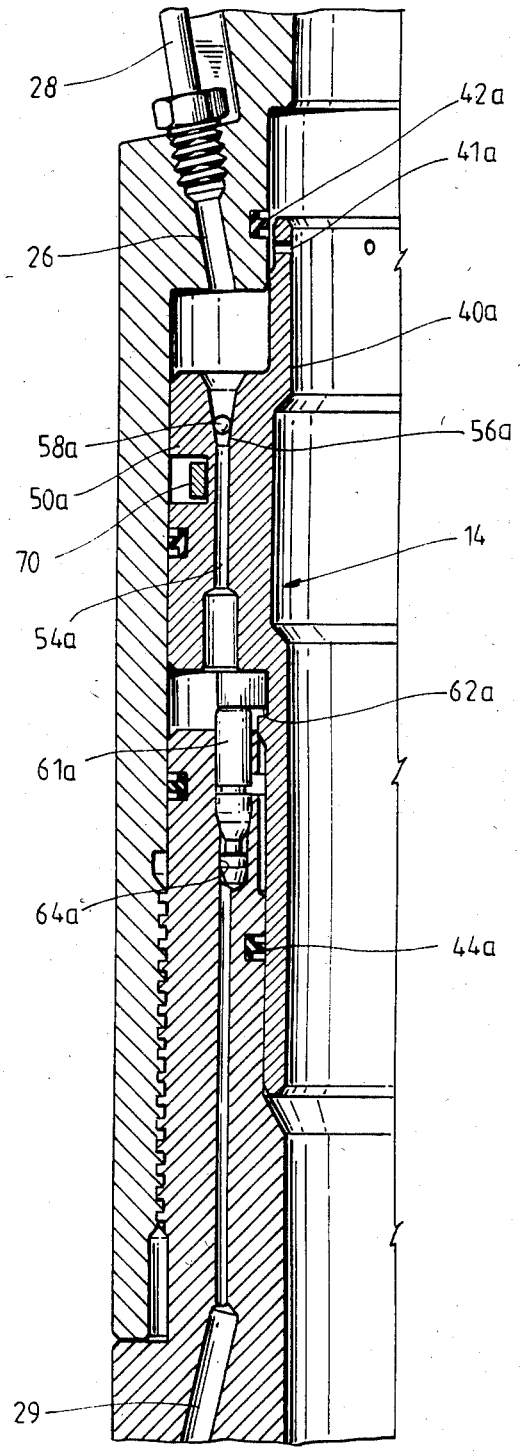
FIG. 6B is a view similar to FIG. 6A but showing the parts in the position after movement of the hydraulic piston.

The structure and operation of the lower nipple 14 is similar to the upper nipple 12, and for convenience of reference like parts will be numbered with like numerals with the suffix "a". Referring now to FIGS. 1, 5A, 5B, 6A and 6B, the lower nipple 14 includes a vertically moving means or shifting sleeve **40*a* shown in its initial position in FIGS. 5A and 6A held in an upper position by a shearable bolt 60 whereby control fluid may readily flow from the control line 28, through the passageway 26, through piston opening 54*a*, and out the passageway 29 to a downhole tubing safety valve. In the event that the tubing safety valve becomes inoperative, a second or retrievable type safety valve is positioned in the polished bores 18, 32 and 34 in the nipple 10 and a valve element such as the ball 58*a* (FIG. 6B) is inserted in the control line 28 to seat on the valve seat 56*a* in the opening 54*a* in the piston 50*a* to close off communication of the passageway 26 to the line 29. Supplying hydraulic pressure to the control line 28 forces the piston 50*a* downwardly and as best seen in FIG. 5B shears the bolt 60*a*. As discussed in U.S. patent application Ser. No. 440,667, a C-ring 70 contracts between the broken ends of the bolt 60*a* for preventing the bolt parts from returning to the initial position. Downward movement of the piston 50*a* carries the sleeve 40*a* downwardly to bring the openings 41*a* below the bottom of the seal 42*a* whereby hydraulic control fluid in the fluid passageway 26 is now switched to the bore 18** to provide control fluid to a retrievable type safety valve positioned therein. However, the top of the sleeve 40*a* extends above the seal 42*a* to prevent the seal 42*a* from falling into the bore 18. In addition, as best seen in FIG. 6B, downward movement of the piston 50*a* and sleeve 49*a* carries the shoulder 62*a* which engages metal plug 61*a* driving it into the recess 64*a* to provide a metal-to-metal seal preventing further fluid flow to the passageway 29 even in the event that the elastomer seals in the nipple 10 fail.

However, the hydraulic fluid positioned in the passageways 20 and 26 below the pistons 50 and 50*a* are forced out through suitable passageways as the shut-off plugs 61 and 61*a* are seated. For example, as to plug 61*a*, it may include a spring-loaded check valve 72 in a passageway 74 for displacing the trapped fluid under the piston 50*a*. As to the trapped fluid under the piston 50, as best seen in FIGS. 1–4, a line 80 is provided between the compartment 82 under the piston 50 to the passageway 26 above the piston 50*a*. The passageway 80 includes a plug 84 which moves out of the passage 80 as the sleeves 40 and 40*a* move downwardly to allow the displaced fluid from the chamber 82 to be displaced into the passageway 26 above the lower piston 50*a*.

The hydraulic actuation of the nipple 10 has several important advantages over the prior art method of mechanically shifting sleeves. For example, if the present nipple 10 is actuated mechanically, three different wireline operations must be performed in the well which is both time-consuming and expensive. That is, wireline operations must be performed to move the lower sleeve 40*a*, to move the upper sleeve 40, and to insert a retrievable safety valve. In the present invention, the retrievable safety valve is inserted in the bore 18 with a single wireline trip and the sleeves 40 and 40*a* are moved hydraulically. In addition, it is advantageous to place the retrievable or secondary valve in the bore 18 before moving the sleeves 40 and 40*a* as this provides a cleaner operation by reducing the amount of well fluids contaminating the control passageways. Preferably, the lower nipple 14 is actuated first to provide space to move plug 84.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will readily suggest themselves to those skilled in the art and which are encompassed within the spirit of the invention and the scope of the appended claims.

What is claimed is:

1. A hydraulic control fluid communication nipple for switching control fluid from one location to a second location in a well tool comprising, a body having a longitudinal bore therethrough, a fluid passageway in the body offset from the bore adapted to be connected to the well surface for receiving hydraulic control fluid for normally supplying control fluid to a first location, vertically moving means in the body for opening communication of said fluid passageway to the bore, a hydraulic piston vertically movable in the body and connected to said vertically moving means, said piston movable in said passageway, said piston including means responsive to control from the well surface for moving the vertically moving means and switching control fluid from the fluid passageway to the bore, and said piston includes a bypass opening therethrough, and said opening including a seat adapted to receive a valve element therein for closing said opening.

2. A hydraulic control fluid communication nipple for switching control fluid from one location to a second location in a well tool comprising, a body having a longitudinal bore therethrough, a fluid passageway in the body offset from the bore adapted to be connected to the well surface for receiving hydraulic control fluid for normally supplying control fluid to a first location, vertically moving means in the body for opening communication of said fluid passageway to the bore, a hydraulic piston vertically movable in the body and connected to said vertically moving means, said piston movable in said passageway, said piston including means responsive to control from the well surface for moving the vertically moving means and switching control fluid from the fluid passageway to the bore, and wherein the vertically moving means is a sleeve telescopically engaging the body to form part of said fluid passageway, and seal means between the sleeve and the body adjacent the top and bottom of the sleeve, an opening through the sleeve initially positioned above the upper seal, but positioned below the upper seal when the sleeve is vertically moved downward by the piston.

3. The apparatus of claim 2 wherein said opening is spaced below the upper end of the sleeve a distance whereby when the opening is positioned below the upper seal, the upper end of the sleeve will cover the upper seal preventing the upper seal from falling into the bore.

4. A hydraulic control fluid communication nipple for switching control fluid from one location to a second location in a well tool comprising, a body having a longitudinal bore therethrough, a fluid passageway in the body offset from the bore adapted to be connected to the well surface for receiving hydraulic control fluid for normally supplying control fluid to a first location, vertically moving means in the body for opening communication of said fluid passageway to the bore, a hydraulic piston vertically movable in the body and connected to said vertically moving means, said piston movable in said passageway, said piston including means responsive to control from the well surface for moving the vertically moving means and switching control fluid from the fluid passageway to the bore, and vertically moving means in the body shutting off communication of fluid in the passageway to said first location in response to movement of the hydraulic piston.

5. A hydraulic control fluid communication nipple for switching control fluid from one location to a second location in a well tool comprising, a body having a longitudinal bore therethrough, a fluid passageway in the body having an inlet and outlet and offset from the bore adapted to be connected to the well surface through a control line for receiving hydraulic control fluid for normally supplying control fluid to the outlet, vertically moving sleeve means in the body for opening communication of the fluid passageway to the bore, a hydraulic piston vertically movable in the fluid passageway between the inlet and the outlet, and connected to the sleeve means, said piston including a bypass opening therethrough for normally passing fluid from the inlet to the outlet, said opening having a seat adapted to receive a valve element from the well surface through the control line for closing communication of the control fluid to the outlet, moving the sleeve and opening communication of the fluid passageway to the bore.

6. The apparatus of claim 5 wherein the bypass opening seat is a smaller cross-sectional area than the cross-sectional area of the inlet.

7. The apparatus of claim 5 including;

vertically moving means in the body shutting off communication of fluid in the passageway to said outlet by a metal-to-metal seal in response to movement of the hydraulic piston.

8. The apparatus of claim 7 wherein the vertical moving means includes a check valve for allowing displacement of hydraulic fluid.

9. A hydraulic control fluid communication nipple for switching control fluid from one location to a second location in a well tool comprising, a body having a longitudinal bore therethrough, first and second switching nipples each comprising, a fluid passageway in the body having an inlet and outlet and offset from the bore and adapted to be connected to a control line to the well surface for receiving control fluid for normally supplying control fluid to a first location, a vertically moving sleeve means in the bore for opening communication of the fluid passageway to the bore, a hydraulic piston vertically movable in the fluid passageway between the inlet and the outlet and connected to the sleeve, said piston including means responsive to control from the well surface for moving the vertically moving sleeve means and switching control fluid from the fluid passageway to the bore, and each of the switching nipples includes, vertically moving means in the body shutting off communication of fluid in the passageway to said outlet by a metal-to-metal seal in response to movement of the hydraulic piston.

10. The apparatus of claim 9 wherein the body includes a line from between the underside of the piston of the fluid passageway of one nipple to the fluid passageway on the top side of the piston of the other nipple for receiving the displaced fluid of the one nipple.

11. The apparatus of claim 10 wherein the vertically moving means of the second nipple includes a check valve for allowing the displacement of hydraulic fluid in the other nipple.

12. A hydraulic control fluid communication nipple for switching control fluid from a primary tubing retrievable safety valve in a well tubing to a secondary retrievable safety valve positioned on the inside of the well tubing comprising, a body having a longitudinal bore therethrough for connection in a well tubing and adapted to receive a secondary safety valve in the bore, a fluid passageway in the body offset from the bore adapted to be connected to the well surface for receiving hydraulic control fluid for normally supplying control fluid to the primary safety valve, vertically moving means in the body for opening communication of said fluid passageway to the bore for controlling a secondary safety valve in the bore and for closing the communication of said fluid passageway to the primary safety valve, and a hydraulic piston vertically movable in the body and connected to said vertically moving means, said piston movable in said passageway, said piston including means responsive to control from the fluid passageway for moving the vertically moving means and switching control fluid from the primary safety valve to the bore for controlling a secondary safety valve.

* * * * *